US010882346B2

(12) United States Patent
Taira et al.

(10) Patent No.: US 10,882,346 B2
(45) Date of Patent: Jan. 5, 2021

(54) INK JET RECORDING APPARATUS

(71) Applicant: CANON KABUSHIKI KAISHA, Tokyo (JP)

(72) Inventors: Hiroshi Taira, Fuchu (JP); Kazuhiko Sato, Tokyo (JP); Kazuo Suzuki, Yokohama (JP); Mitsutoshi Nagamura, Tokyo (JP); Satoshi Azuma, Tokyo (JP); Tomoki Yamamuro, Kawasaki (JP); Shingo Nishioka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/585,556

(22) Filed: Sep. 27, 2019

(65) Prior Publication Data

US 2020/0114666 A1 Apr. 16, 2020

(30) Foreign Application Priority Data

Oct. 12, 2018 (JP) ..... 2018-193735

(51) Int. Cl.
*B41J 29/393* (2006.01)
*B41J 29/38* (2006.01)

(52) U.S. Cl.
CPC ..... *B41J 29/393* (2013.01); *B41J 29/38* (2013.01)

(58) Field of Classification Search
CPC ..... B41J 29/393; B41J 2/2054; B41J 2/2146; B41J 15/00; B41J 29/38
See application file for complete search history.

(56) References Cited

U.S. PATENT DOCUMENTS 7,445,313 B2 * 11/2008 Tsutsumi ..... B41J 29/393 347/105
2016/0082753 A1 * 3/2016 Sasaki ..... B41J 13/0045 347/16

FOREIGN PATENT DOCUMENTS

JP 4715209 B2 7/2011

* cited by examiner

*Primary Examiner* — Lisa Solomon

(74) *Attorney, Agent, or Firm* — Canon U.S.A., Inc. IP Division

(57) ABSTRACT

An ink jet recording apparatus of a line-recording-head type includes one or more recording heads using the same ink and performs recording of an image by conveying a recording medium using multiple passes through a recording region of the recording head while the recording medium is repeatedly conveyed backward and forward to speed up recording and improve image quality. A recording head is controlled to provide that an amount of ink applied to a recording medium in a case where the recording medium is conveyed at a first speed is smaller than an amount of ink applied to the recording medium in a case where the recording medium is conveyed at a second speed higher than the first speed in both of a case where the recording medium is accelerated and a case where the recording medium is decelerated.

7 Claims, 13 Drawing Sheets

INK JET RECORDING APPARATUS

BACKGROUND

Field

The present disclosure relates to an ink jet recording apparatus.

Description of the Related Art

Japanese Patent No. 4715209 discusses, as a full-line type ink jet printer, a recording apparatus which includes a recording head covering an entire recording width and completes forming an image by repeatedly moving a recording medium back and forth to pass through a recording region of the recording head a plurality of times.

In a case where a method described in Japanese Patent No. 4715209 is used, it is assumed that a recording medium is decelerated when a movement direction of the recording medium is reversed from forward to backward or from backward to forward and is accelerated in the reversed direction.

SUMMARY

Using the method described in Japanese Patent No. 4715209, the present inventors tried recording while a recording medium was decelerated or accelerated in order to speed up recording. It was found that a state of an ink droplet when the ink droplet reached the recording medium in a case where the recording medium was accelerated or decelerated was different from that in a case where the recording medium was moved at a constant speed. Accordingly, a part of an image which is recorded while the recording medium is moved at a constant speed is different from a part of the image which is recorded while the recording medium is accelerated or decelerated, and the difference may be visually recognized as unevenness.

In light of the above-described issue, the present disclosure features speed-up of recording while securing an image quality of an image to be recorded.

According to an aspect of the present disclosure, an ink jet recording apparatus includes a recording head in which a plurality of nozzles for discharging ink is arranged to correspond to a width of a recording medium, a conveyance unit configured to convey the recording medium in a direction intersecting with a direction in which the plurality of nozzles is arranged, and a control unit configured to cause the conveyance unit to convey the recording medium repeatedly backward and forward, to perform recording by discharging ink from the recording head to the recording medium while the recording medium is conveyed backward and forward with a predetermined region of the recording medium passing through a position facing the recording head a plurality of times, and to control the conveyance unit to accelerate or decelerate the recording medium when a direction in which the recording medium is conveyed is reversed from a forward direction to a backward direction or from the backward direction to the forward direction. The control unit controls the recording head to provide that an amount of ink applied to the recording medium in a case where the recording medium is moved at a first speed is smaller than an amount of ink applied to the recording medium in a case where the recording medium is moved at a second speed higher than the first speed in both of a case where the recording medium is accelerated and a case where the recording medium is decelerated.

Further features of the present disclosure will become apparent from the following description of exemplary embodiments with reference to the attached drawings.

DESCRIPTION OF THE EMBODIMENTS

Figure 1:
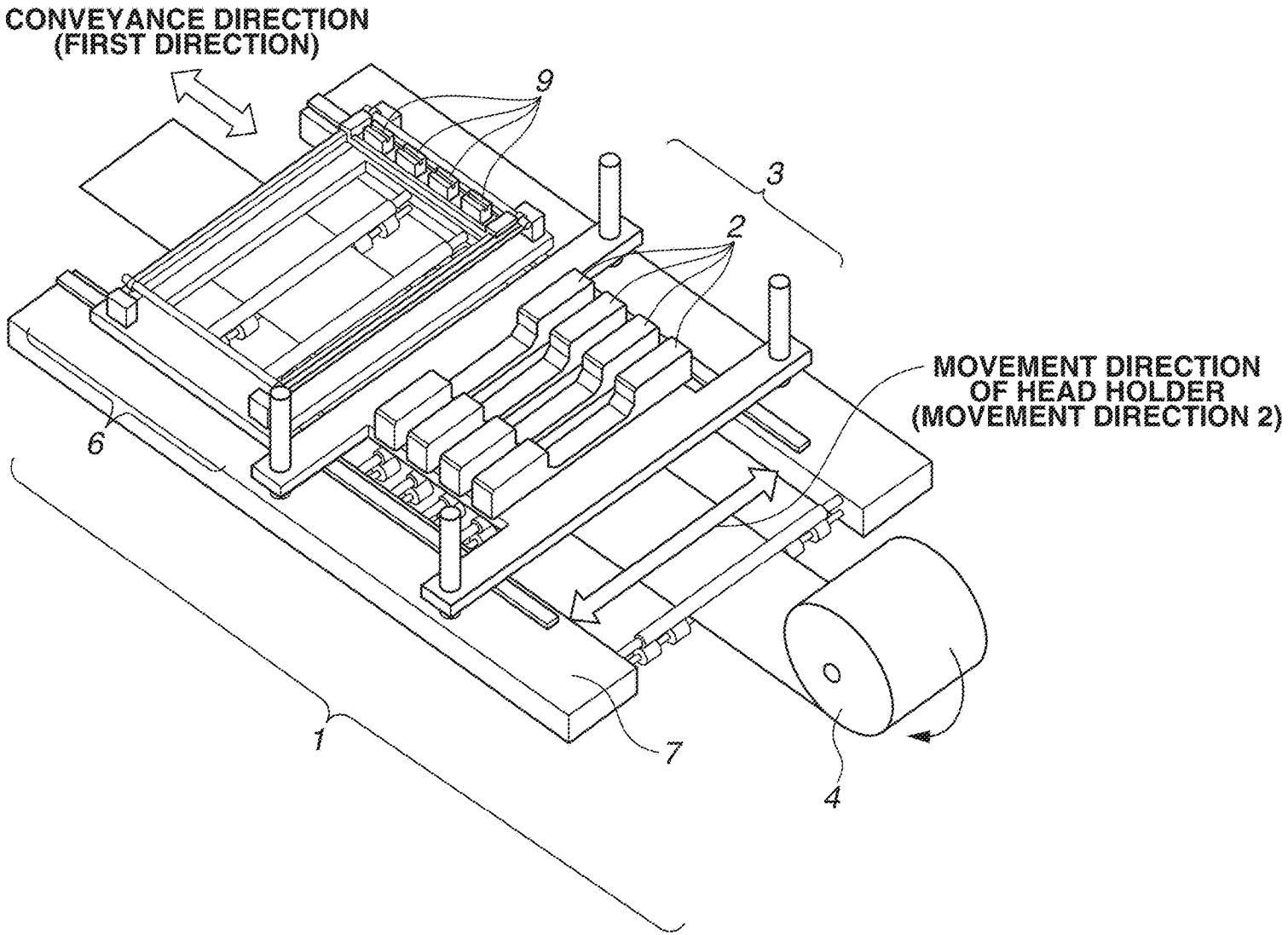
FIG. 1 is an external perspective view of a main part of a recording apparatus according to exemplary embodiments.

A first exemplary embodiment of the present disclosure will be described in detail below with reference to the attached drawings. Components having the same functions are denoted by the same reference numerals, and their descriptions are omitted in some cases.

In the description, a term "recording" means forming information regardless of meaningful information or meaningless information in addition to forming meaningful information such as a letter and a figure. Further, "recording" broadly means forming an image, a pattern, and the like on a recording medium and processing a recording medium regardless of whether information is actualized to be visually perceivable by a person. A term "recording medium" broadly means not only paper used in a general recording apparatus but also a medium which can receive ink, such as cloth, a plastic film, a metal plate, glass, ceramics, wood, and leather. A term "ink" (referred to as "liquid" in some cases) should be also broadly interpreted as with the case of the definition of the above-described "recording". Accordingly, the term "ink" means liquid which is applied to the recording medium to form an image, a pattern, and the like, to process a recording medium, or to process the ink (for example, to solidify or insolubilize a coloring agent in the ink to be applied to the recording medium). A term "nozzle" comprehensively means a discharge port or a fluid channel communicating with the discharge port unless otherwise stated.

A recording head substrate (a head substrate) to be described below means not a simple base substance formed of a silicon semiconductor but a configuration provided with some elements, wiring, and the like. Further, a term "on the substrate" means not only simply "on" an element substrate but also a surface of the element substrate and an inner side of the element substrate near the surface of the element substrate.

Figure 2:
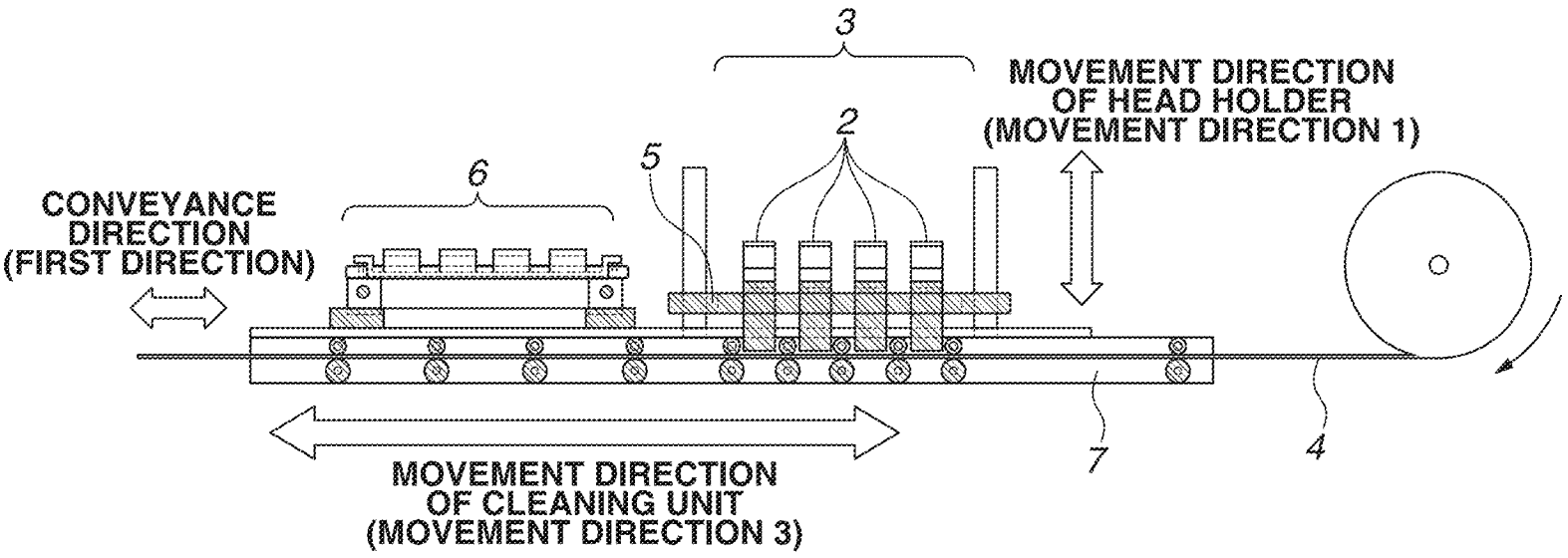
FIG. 2 is a cross-sectional view of the main part of the recording apparatus illustrated in FIG. 1 when printing is being performed.
Figure 3:
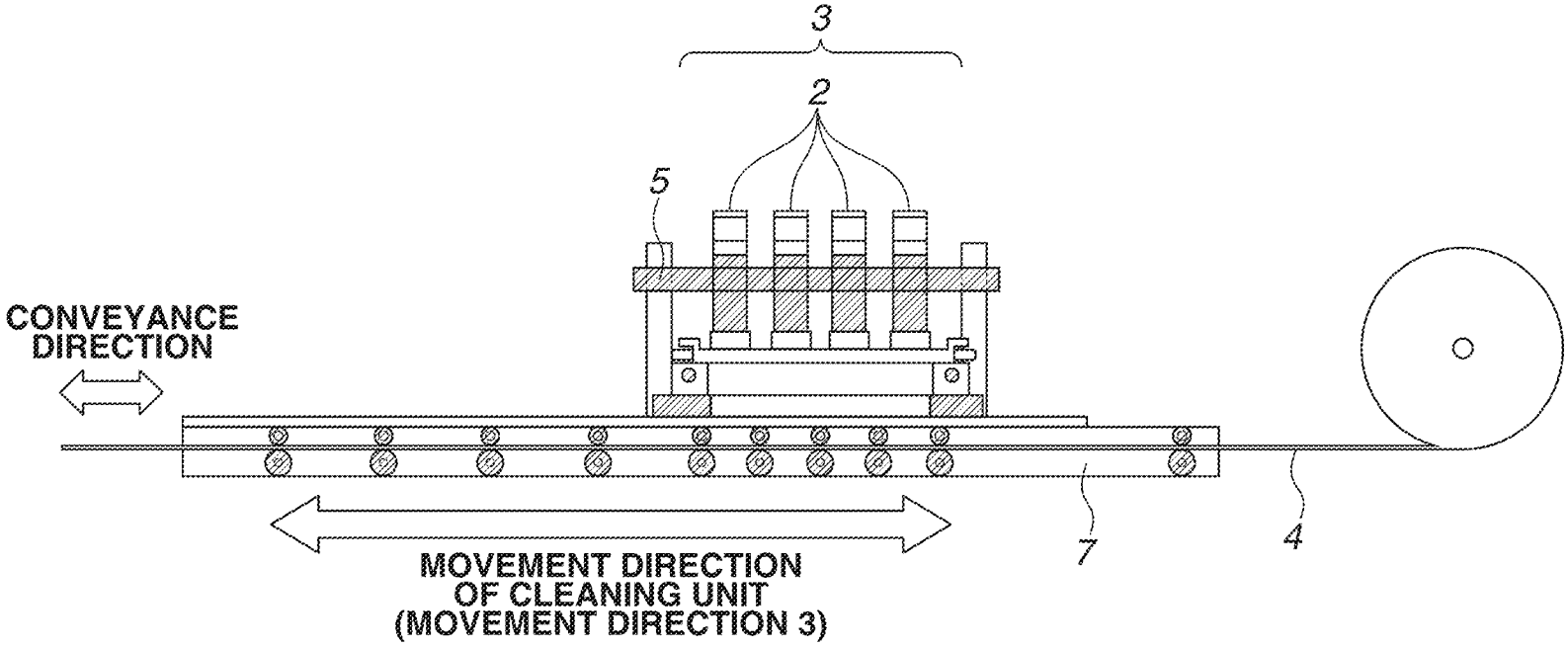
FIG. 3 is a cross-sectional view of the main part of the recording apparatus illustrated in FIG. 1 when a cleaning operation is being performed.

FIG. 1 is an external perspective view of a configuration of a main part of an ink jet recording apparatus, with a main focus on a recording unit of the ink jet recording apparatus (hereinbelow, also referred to as a recording apparatus) which performs recording using a full-line recording head according to the present exemplary embodiment. FIGS. 2 and 3 are side cross-sectional views illustrating a cross sectional structure of the main part of the recording apparatus illustrated in FIG. 1 when recording is being performed and when a cleaning operation is being performed, respectively.

A recording apparatus 1 illustrated in FIGS. 1, 2, and 3 is a line printer which performs recording on a sheet-like recording medium using a line recording head (hereinbelow, also referred to as a recording head) while conveying the recording medium in a conveyance direction (a first direction). A recording medium can be conveyed backward and forward. The recording apparatus includes a holder which holds a recording medium 4 such as a continuous sheet wound in a roll state, a conveyance unit 7 which conveys the recording medium 4 in the conveyance direction at a predetermined speed, and a recording unit 3 which performs recording on the recording medium 4 using a recording head 2. The recording medium is not limited to the continuous roll sheet and may be a cut sheet.

The recording apparatus 1 further includes a cleaning unit 6 which cleans a nozzle surface of the recording head 2 with a wiper. The recording apparatus 1 further includes a cutter unit (not illustrated) which cuts the recording medium and a sheet discharge tray (not illustrated) on a downstream side of the recording unit 3 along a conveyance path of the recording medium. The recording unit 3 includes four recording heads 2 corresponding to four different ink colors, namely, cyan (C), magenta (M), yellow (Y), and black (K). According to the present exemplary embodiment, the configuration which includes four recording heads and discharges four color inks is described. However, the number of the recording heads and the number of colors of ink to be used in recording are not limited to the above-described numbers.

Each color ink is supplied from an ink tank (not illustrated) to the recording head 2 via each ink tube (not illustrated). The four recording heads 2 are integrally supported by a head holder 5, and a mechanism which can move the head holder 5 up and down (a movement direction 1) is provided so that a distance between the four recording heads 2 and a surface of the recording medium 4 can be changed. Further, the head holder 5 can be moved in a direction (a movement direction 2) perpendicular to the conveyance direction of the recording medium 4 along the recording medium.

The cleaning unit 6 includes four wiper units 9 corresponding to the four recording heads 2. The cleaning unit 6 can be slid by a driving motor (not illustrated) (a movement direction 3).

FIGS. 1 and 2 illustrate a state of the recording apparatus when recording is being performed, and the cleaning unit 6 is located on a downstream side of the recording unit 3 in the conveyance direction of the recording medium. FIG. 3 illustrates a state of the recording apparatus when the cleaning operation is being performed, and the cleaning unit 6 is located immediately below the recording heads 2 of the recording unit 3. In FIGS. 2 and 3, a direction in which the cleaning unit 6 is moved is indicated by an arrow (the movement direction 3).

Figure 4A:
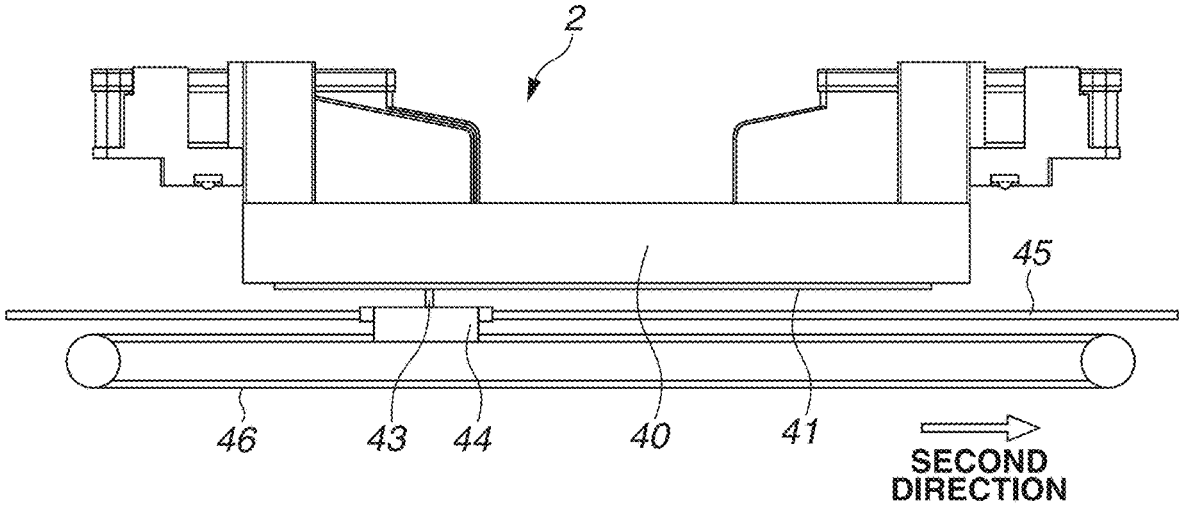
FIGS. 4A, 4B, 4C, and 4D are schematic diagrams of a recording head according to the exemplary embodiments.
Figure 4B:
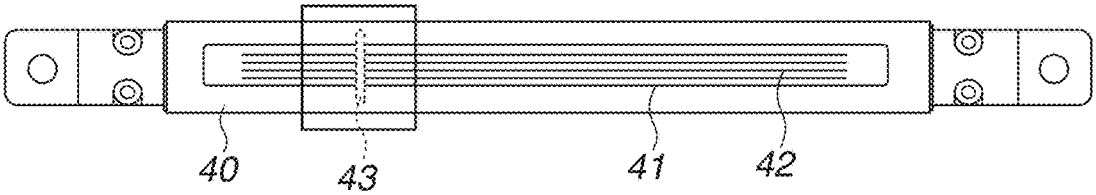

FIGS. 4A, 4B, 4C, and 4D are diagrams illustrating a configuration of one of the recording heads 2. FIG. 4A is a side view of the recording head 2 viewed in the conveyance direction of the recording medium (the first direction), and FIG. 4B is a bottom view of the recording head 2 viewed in a direction perpendicular to the first direction and a second direction.

As an ink jet recording method, a method using a heating element, a method using a piezoelectric element, a method using an electrostatic element, a method using a microelectromechanical system (MEMS) element, and the like can be adopted. The recording head 2 is a full-line recording head in which a nozzle array is formed in a range covering a maximum width of a recording medium assumed to be used. Nozzles are arranged in a direction (the second direction) intersecting with the first direction, for example, a direction perpendicular to the first direction.

Figure 4C:
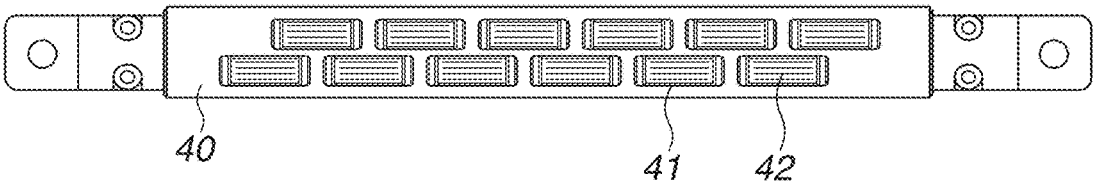
Figure 4D:
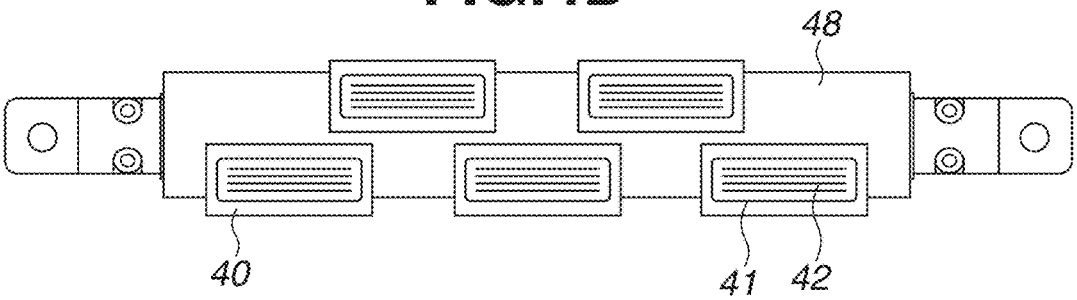

As illustrated in FIGS. 4B, 4C, and 4D, a nozzle tip 41 is provided on a base substrate 40. The nozzle tip 41 has a nozzle surface on which a plurality of nozzle arrays 42 for discharging ink is formed and includes a nozzle substrate in which an energy element formed corresponding to each nozzle is embedded. The four nozzle arrays 42 are arranged in parallel in the second direction.

In order to wipe ink and dust adhering to the nozzle surface of the recording head 2, a driving belt 46 is rotationally driven while a shaft guides and supports a wiper holder 44, so that the wiper holder 44 can be moved along a wiping direction (the second direction) of a wiper blade 43.

In a configuration of the recording head in FIG. 4B, one nozzle tip 41 is arranged on one base substrate 40. However, a plurality of nozzle tips 41 may be arranged on one base substrate 40 as illustrated in FIG. 4C. Further, also in a configuration in which a plurality of base substrates 40 is connected by a support member 48 as illustrated in FIG. 4D, a similar effect can be achieved.

Figure 5:
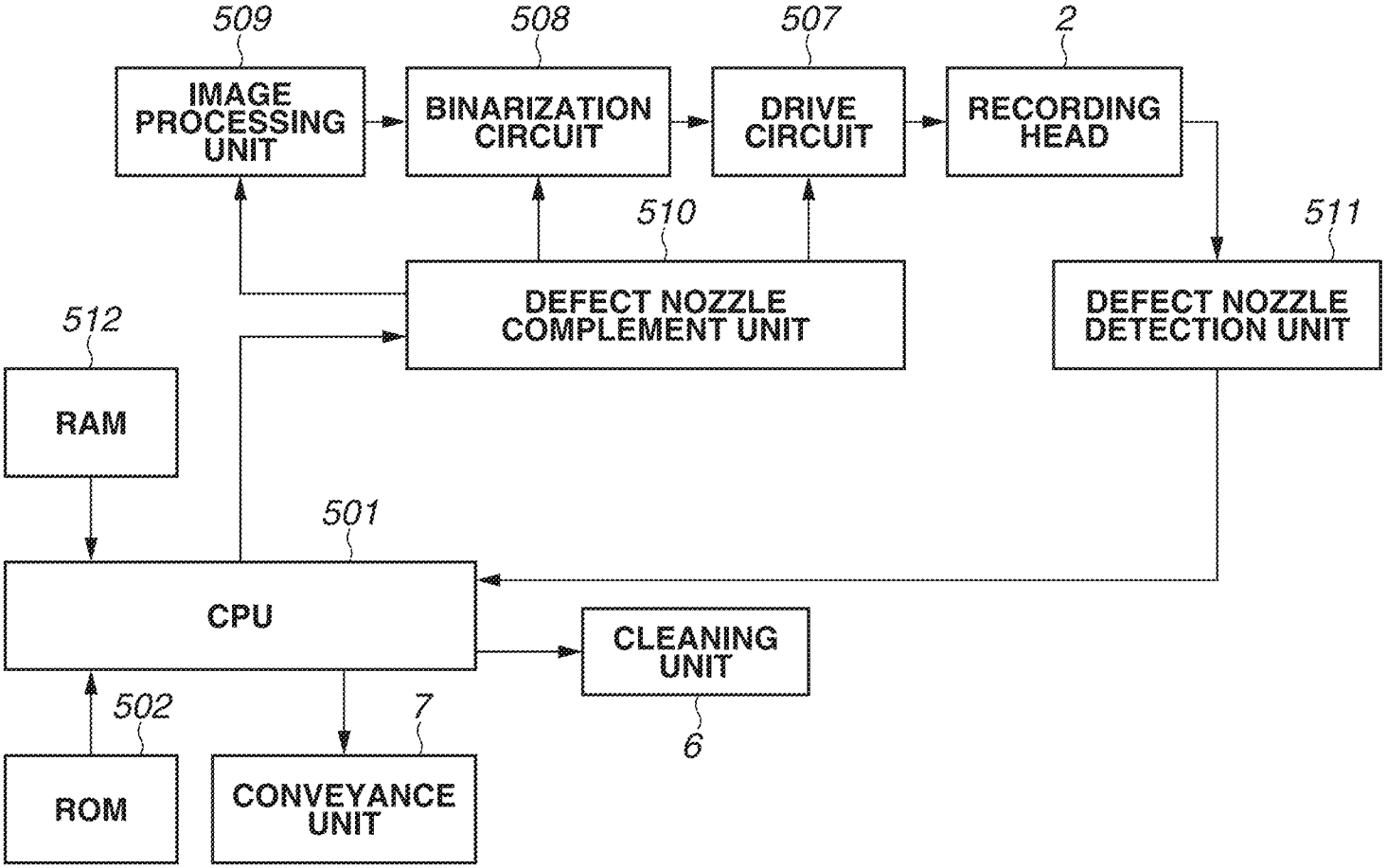
FIG. 5 is a block diagram schematically illustrating a control configuration of the recording apparatus according to the exemplary embodiments.

FIG. 5 is a block diagram schematically illustrating a control configuration of the recording apparatus illustrated in FIG. 1.

As illustrated in FIG. 5, a central processing unit (CPU) 501 functions as a control unit which reads a program for controlling a system from a read-only memory (ROM) 502, executes the program, and controls an entire system according to the program. In this case, the program is developed in a random access memory (RAM) 512 which is used as a work area. In other words, the RAM 512 temporarily stores input data and data necessary for processing to be executed by the CPU 501. The CPU 501 also controls operations of the cleaning unit 6, the conveyance unit 7, and the like.

The CPU 501 further controls a recording operation by the recording head 2 via a drive circuit 507, a binarization circuit 508, and an image processing unit 509. The image processing unit 509 performs predetermined image processing on input color image data to be recorded. In other words, the image processing unit 509 executes, for example, data conversion to map a color gamut to be reproduced based on the input image data of each of red, green, and blue (RGB) color components in a color gamut to be reproduced by the recording apparatus. The image processing unit 509 further performs processing for calculating density data of each of CMYK color components, each of which is color separation data corresponding to a combination of ink for reproducing a color indicated by each data based on the converted data, and performs gradation conversion on each color separation data separated into each color.

The binarization circuit 508 performs halftone processing and the like on multi-valued density image data converted by the image processing unit 509 and then converts the processed image data into binary data (bitmap data). The drive circuit 507 executes a discharge operation of an ink droplet from the recording head 2 according to the binary data obtained by the binarization circuit 508.

A defect nozzle complement unit 510 executes processing for generating complementary data for a defect nozzle (hereinbelow, referred to as complementary processing) which is executed according to each exemplary embodiment described below. A defect nozzle detection unit 511 detects a nozzle (a defect nozzle) of which an ink droplet discharge state is inappropriate from among a plurality of nozzles formed on the recording head 2. In this case, the CPU 501 reads pattern data stored in the ROM 502, drives the recording head 2 via the drive circuit 507 based on the read pattern data, controls units used for a recording operation such as the conveyance unit 7, and records a pattern for detecting a defect nozzle on a recording medium. Further, the defect nozzle detection unit 511 reads the recorded pattern to detect a defect nozzle.

Figure 6:
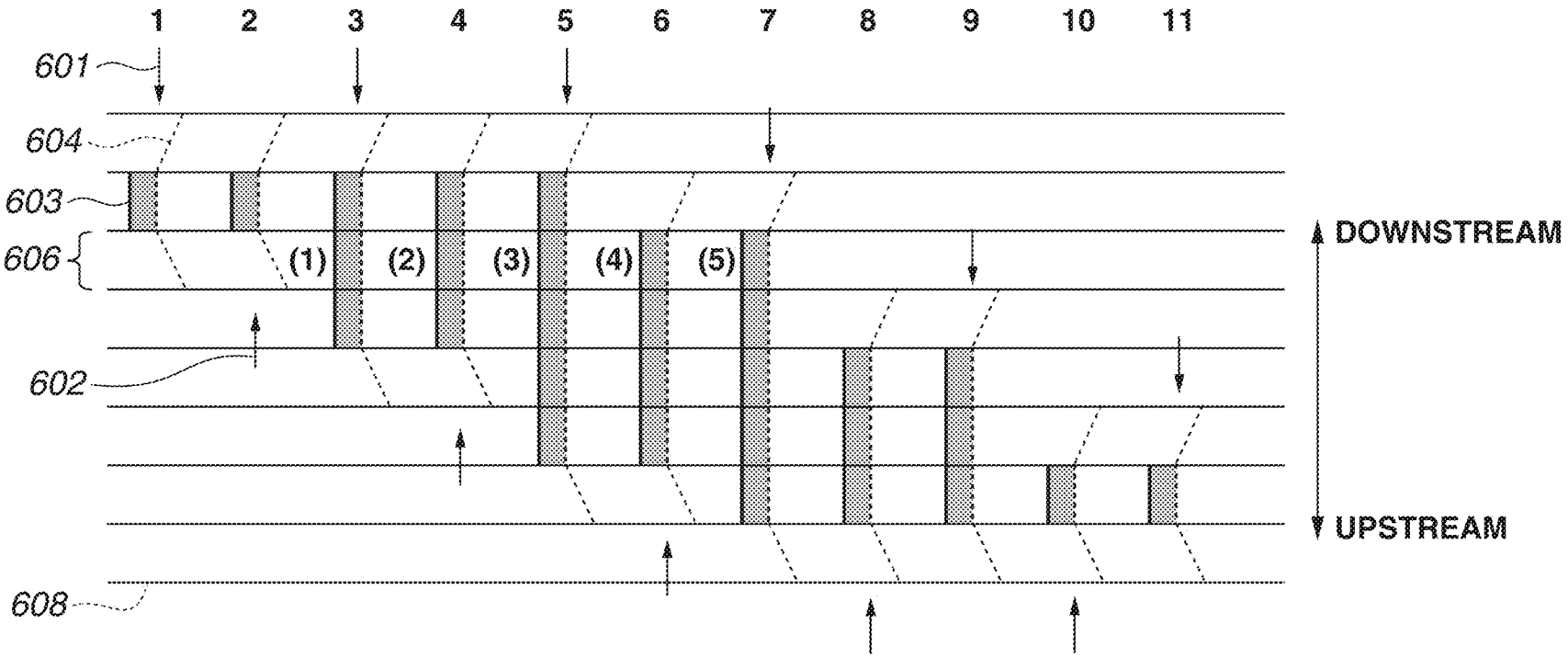
FIG. 6 is a schematic diagram illustrating multi-pass recording according to a comparative example.

A comparative example to be used for comparison with the present exemplary embodiment is to be described with reference to FIG. 6. FIG. 6 is a diagram illustrating processes for forming an image in each recording conveyance. An arrow 601 indicates a movement direction of the recording head relative to a recording medium. Therefore, in conveyance indicated in a recording conveyance number 1 on a top column in FIG. 6, recording is performed by discharging ink from the recording head while conveying a recording medium 608 to a downstream side. Recording is performed in this way in a case where the recording conveyance number is an odd number. Although the recording head is stationary, the recording head is moved relative to the recording medium to the upstream side. For this reason, the recording operation is described in this manner. Subsequently, an arrow 602 indicated in a recording conveyance number 2 indicates that recording is performed by discharging ink from the recording head while conveying the recording medium to an upstream side. Recording is performed in this way in a case where the recording conveyance number is an even number.

According to a recording method in FIG. 6, recording is performed by reciprocating a sheet being conveyed in a downstream direction and an upstream direction. In this way, multi-pass recording is performed, in which recording is performed on a predetermined region of a recording medium by a plurality of times of separate relative movements of the recording head and the recording medium. In a case of single-pass recording by a line recording head method, it is necessary to arrange a plurality of nozzle arrays of the same color to produce a multi-pass effect, but in a case of multi-pass recording, an image with high image quality can be provided by securing one or more nozzle arrays of the same color. In other words, a line recording head method using a low-priced configuration can achieve high image quality.

Figure 7A:
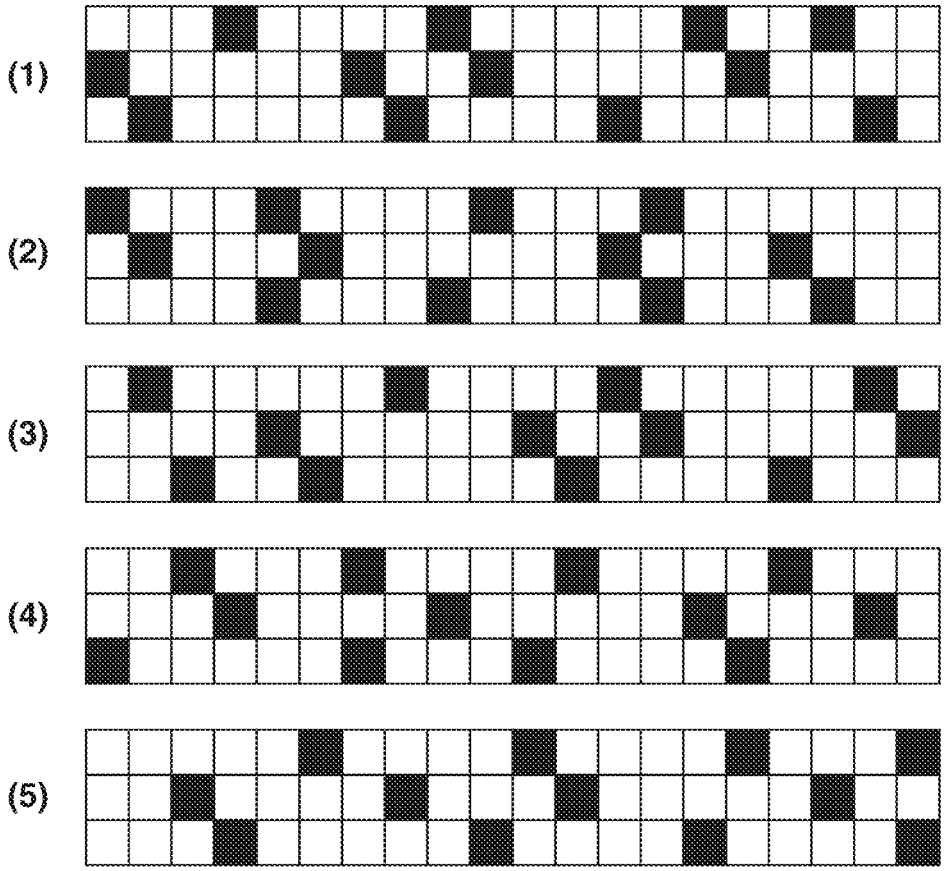
FIGS. 7A and 7B are schematic diagrams specifically illustrating a thinning method in multi-pass recording according to the comparative example.
Figure 7B:
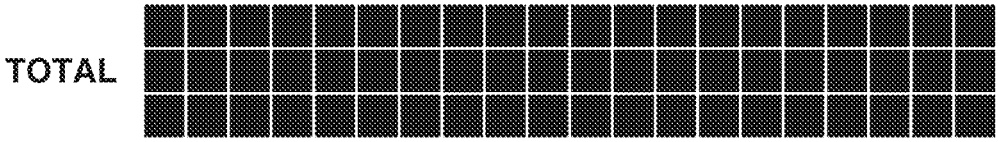

Further, in FIG. 6, a value of a recording ratio 603 is higher toward a left side of FIG. 6. (Please see (6A) in the lower part of FIG. 6.) A region 606 is defined as a region A. In the region A 606, an image is formed by five passes (five times of conveyance). A thinning method in each pass illustrated in FIG. 6 is specifically described with reference to FIGS. 7A and 7B. Thinning in each pass is performed by applying a recording ratio for thinning to image data. FIG. 7A illustrates an example of a recording ratio. One square represents one dot of image data. A black square represents image data to be recorded, and a white square represents image data not to be recorded. A vertical axis corresponds to the conveyance direction in FIG. 6, and a horizontal direction corresponds to the nozzle array. FIG. 7B illustrates an image obtained by overlapping recording patterns (1) to (5). It can be confirmed that the recording ratios are designed so that the dot to be recorded in each pass does not overlap with each other, and all dots are recorded. Further, the recording patterns (1) to (5) in the respective passes include the same number of black squares which indicate that the recording ratios are the same. In FIG. 6, a solid line of the recording ratio 603 indicates that the recording ratio is the same.

In FIG. 6, a dotted line 604 indicates a movement speed of the recording head relative to the recording medium in the recording conveyance number 1, and a position of the dotted line indicates that the movement speed becomes faster from a right side toward a left side. (Please see (6B) in the lower part of FIG. 6.) In other words, a diagonal dotted line portion indicates acceleration and deceleration when the movement direction of the recording medium is reversed, and a perpendicular dotted line portion indicates a constant speed. In the recording conveyance number 1, the dotted line indicates that the movement speed is accelerated, constant, and then decelerated.

It is assumed that it takes two seconds to accelerate the recording medium, two seconds to decelerate the recording medium and one second to convey the recording medium at a constant speed so that the recording medium passes through the region A. Further, there are eleven recording conveyance numbers, and it means that an image is completed by reciprocal movement of 11 times. An image formation time length in FIG. 6 is calculated as 74 seconds based on the time length for the recording medium to pass through each region defined as above. Further, a moving distance is 55 times the region A.

As illustrated in FIG. 6, if printing is performed only in a constant speed region, a moving time length for acceleration and deceleration is a non-recording time length, so that printing takes time including the non-recording time length.

Figure 8:
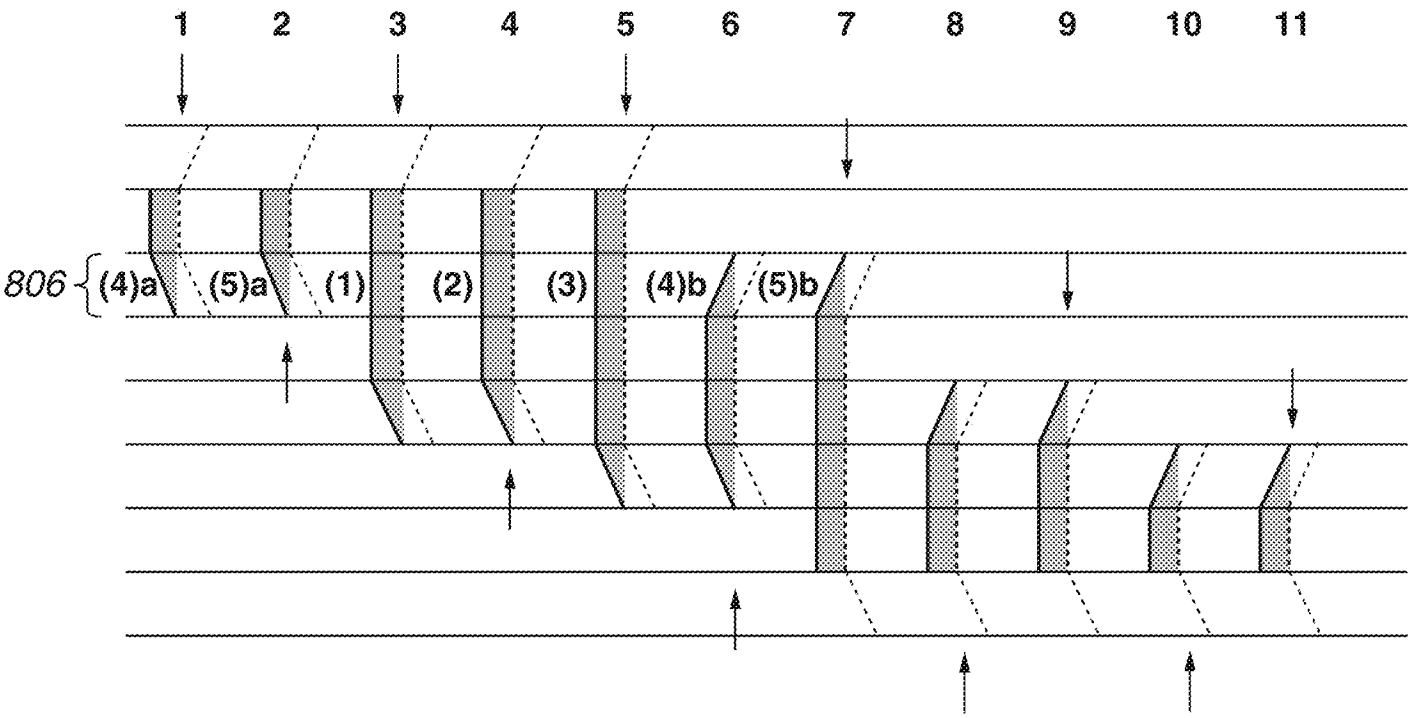
FIG. 8 is a schematic diagram illustrating multi-pass recording according to a first exemplary embodiment.

A multi-pass recording method according to the first exemplary embodiment is described with reference to FIG. 8. Contents indicated by respective numbers, solid lines 603 indicating a recording ratio (Please see (8A) in the lower part of FIG. 8), dotted lines 604 indicating a movement speed of the recording head relative to the recording medium (Please see (8B) in the lower part of FIG. 8), arrows, and the like are similar to those in FIG. 6, and the descriptions thereof are omitted. A characteristic point which is different from FIG. 6 is described in detail. A region 806 is defined as a region B. The region B 806 has a width equal to that of the region A 606 in FIG. 6, but a recording ratio 603 in each of the recording conveyance numbers is different from that of the region A 606. Specifically, in FIG. 6, recording ratios in the recording conveyance numbers 6 and 7 are similar in the recording patterns (1), (2), and (3). However, the recording ratios in the recording conveyance numbers 6 and 7 in FIG. 8 are indicated by diagonal solid lines. Further, the recording ratios in the recording conveyance numbers 1 and 2 are also indicated by diagonal solid lines ((4)*a* and (5)*a*). It means that recording is performed while changing an ink application amount by gradually changing the recording ratios in acceleration and deceleration regions where a movement speed 604 of the recording head relative to the recording medium is changed.

Figure 9A:
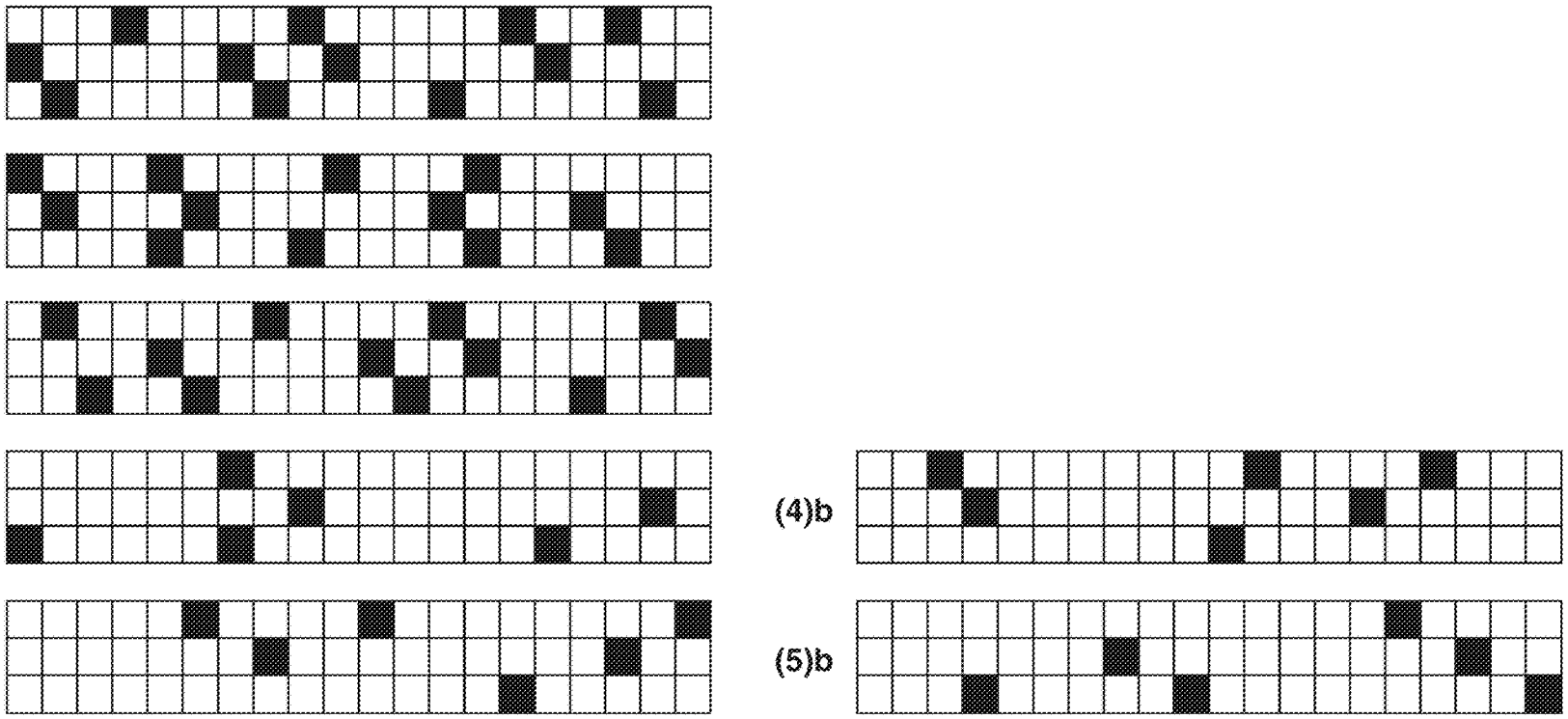
FIGS. 9A and 9B are schematic diagrams illustrating a thinning method in multi-pass recording according to the first exemplary embodiment.
Figure 9B:
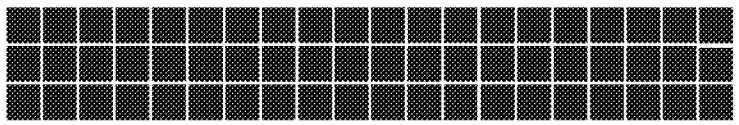

A thinning method in each pass is described in detail with reference to FIGS. 9A and 9B. FIG. 7A includes the recording ratios by a mask as shown in the recording patterns (1) to (5). In contrast, FIG. 9A includes the recording ratios as shown in the recording patterns (1) to (3), which are the same as those in FIG. 7A, and recording ratios as shown in the recording patterns (4)*a*, (4)*b*, (5)*a*, and (5)*b* instead of the recording ratios as shown in the recording patterns (4) and (5). It means that the recording patterns (4) and (5) are divided into the recording patterns (4)*a* and (4)*b*, and (5)*a* and (5)*b*, respectively. Therefore, FIG. 9B is obtained by overlapping the recording patterns (1), (2), (3), (4)*a*, (4)*b*, (5)*a*, and (5)*b*. In other words, it can be confirmed that the recording ratios are designed so that the dot to be recorded in each pass is not recorded on the same position with each other, and all dots are recorded as with the case of FIG. 7A. Further, the recording pattern (4)*a* includes one, two, and three black squares representing dots to be recorded in the first, second, and third rows, respectively. It means that the recording ratio is gradually changed. On the other hand, the recording pattern (4)*b* includes three, two, and one black squares in the first, second, and third rows, respectively, which is an inverse configuration of the recording pattern (4)*a*. The same can be applied to the recording patterns (5)*a* and (5)*b*.

In FIG. 8, it can be understood that the recording ratio is lower as a speed is slower. Therefore, an image quality is improved from a following viewpoint. For example, it is known that a small droplet (a satellite droplet) is further generated after a main droplet is discharged. The satellite droplet is smaller in discharge speed and volume than the main droplet, and thus it is known that landing positions of the main droplet and the satellite droplet in a case where the speed is fast are relatively different from those in a case where the speed is slow. In that case, if the recording ratio on a low-speed side is lowered, image formation on a high-speed side is dominant, and a uniform image is obtained. In addition, if the recording ratio is lowered at an edge portion, a boundary streak is reduced.

Next, the image formation time length in FIG. 8 is focused. It is assumed that it takes two seconds to accelerate the recording medium, two seconds to decelerate the recording medium, and one second to convey the recording medium at the constant speed so that the recording medium passes through the region A as with the case of FIG. 6. Further, there are eleven recording conveyance numbers, and it means that an image is completed by reciprocal movement of 11 times. The image formation time length in FIG. 8 is calculated as 68 seconds based on the time length for the recording medium to pass through each region defined as above. Further, the moving distance is 46 times the region A. It can be understood that the recording is speeded up by approximately eight percent compared with the time length of 74 seconds in FIG. 6. This is because the moving distance is reduced due to an increase of opportunities of acceleration printing and deceleration printing. As described above, recording can be speeded up by performing printing during acceleration and deceleration, and the image quality can be also improved by changing the recording ratio according to a conveyance speed.

Figure 10:
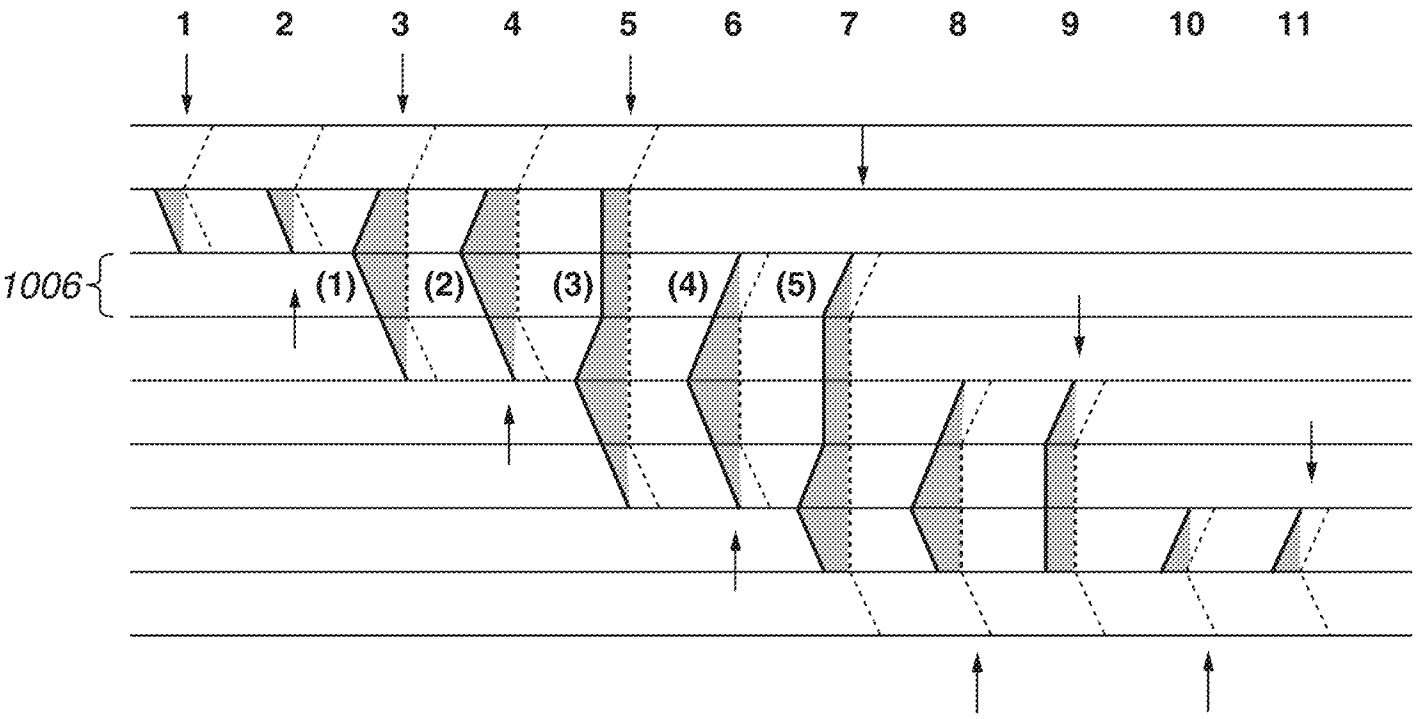
FIG. 10 is a schematic diagram illustrating multi-pass recording according to a second exemplary embodiment.

A recording method according to a second exemplary embodiment is described with reference to FIG. 10. Basic descriptions of the drawing according to the present exemplary embodiment are similar to those of FIG. 8 and thus omitted. In FIG. 10, a region 1006 is defined as a region C. The region C 1006 has a width equal to that of the region A 606 in FIG. 6, but a recording ratio in each of the recording conveyance numbers is different from that of the region A 606. Specifically, it can be understood that the recording ratios in the recording conveyance numbers 3 and 4 are indicated by diagonal solid lines, and the recording ratio increases step by step from a lower row from the recording pattern (3). It means that a result of adding recording patterns (4)*a* and (5)*a* in the recording conveyance numbers 1 and 2 in FIG. 8 to the recording patterns (1) and (2) in the recording conveyance numbers 3 and 4 in FIG. 8 corresponds to the recording patterns (1) and (2) in the recording conveyance numbers 3 and 4 in FIG. 10. According to the first exemplary embodiment, the recording ratios in the constant speed regions are all the same. This is because an upper limit is set for the reason that, for example, bleeding occurs on the recording medium in one movement. According to the second exemplary embodiment, for example, a recording medium on which recording can be performed a larger number of times than that of the first exemplary embodiment is selected, and the recording ratio can be further increased in each recording, so that recording as described in the present exemplary embodiment can be performed. On the other hand, it can be understood that the recording patterns (4) and (5) in the recording conveyance numbers 6 and 7 in FIG. 10 have shapes similar to those of the recording patterns (4)*b* and (5)*b* in FIG. 8.

Next, the image formation time length in FIG. 10 is focused. It is assumed that it takes two seconds to accelerate the recording medium, two second to decelerate the recording medium and one second to convey the recording medium at the constant speed so that the recording medium passes through the region A as with the case of FIG. 6. The image formation time length in FIG. 10 is calculated as 62 seconds based on the time length for the recording medium to pass through each region defined as above. Further, the moving distance is 40 times the region A. It can be understood that the recording is speeded up by approximately 14 percent compared with the time length of 74 seconds in FIG. 6. This is because the moving distance is further reduced due to an increase in the recording ratio in the constant speed region in addition to the acceleration and deceleration printing. As described above, recording can be further speeded up by performing printing during acceleration and deceleration and adding an amount of recording reduced during the acceleration and deceleration to an amount of recording in the constant speed region.

Figure 11:
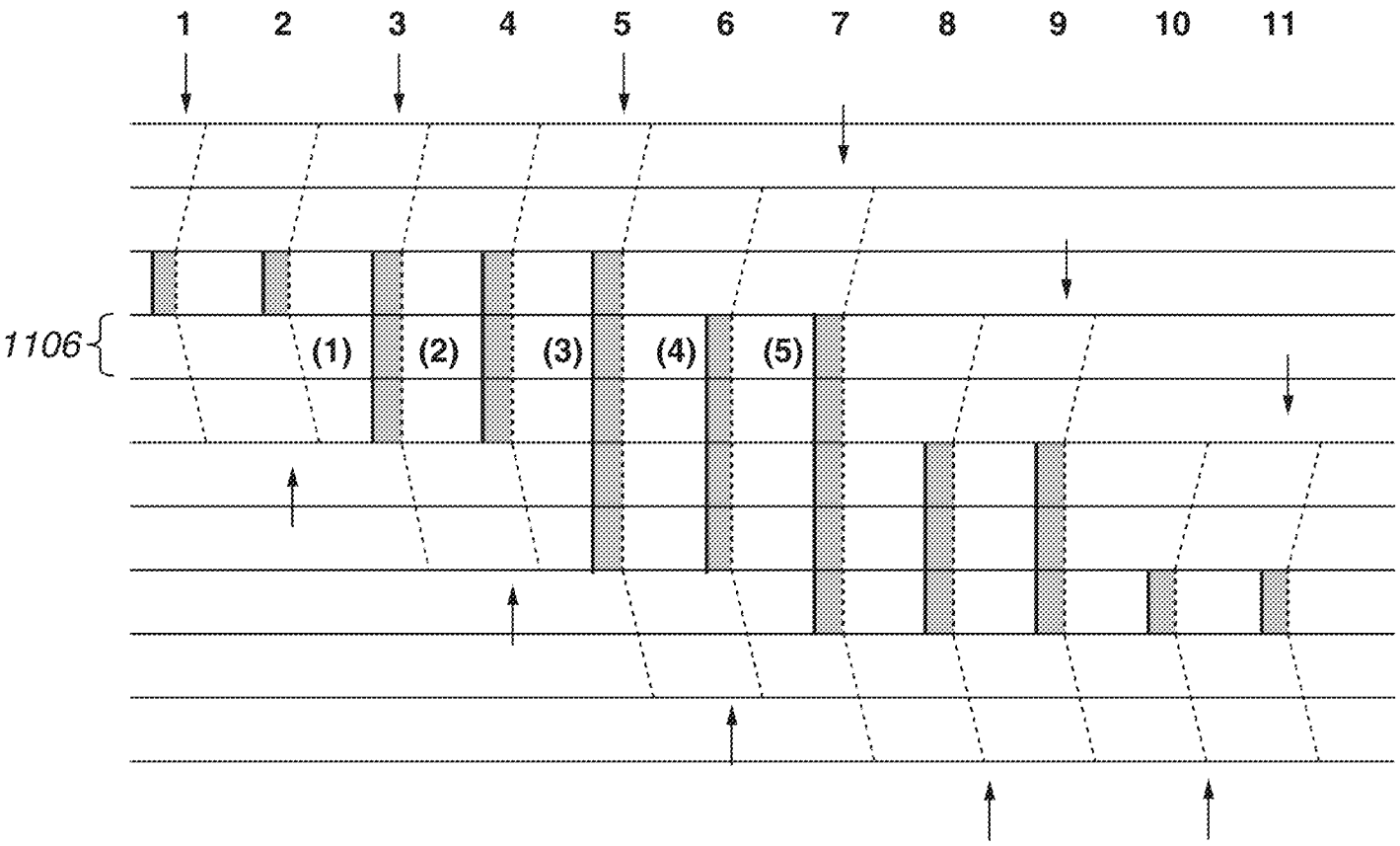
FIG. 11 is a schematic diagram illustrating multi-pass recording according to the comparative embodiment.
Figure 12:
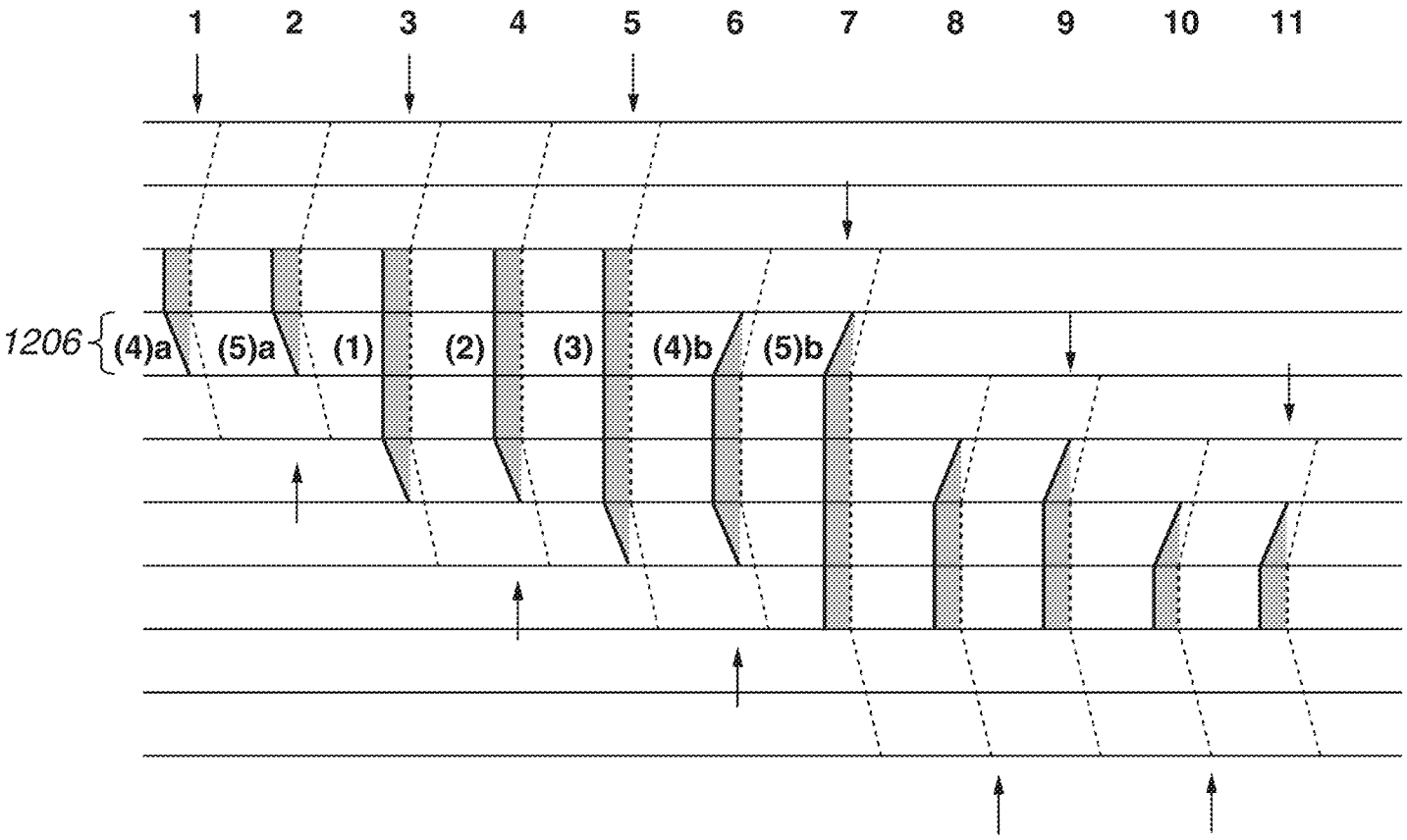
FIG. 12 is a schematic diagram illustrating multi-pass recording according to a third exemplary embodiment.

A recording method according to a third exemplary embodiment is described with reference to FIGS. 11 and 12. Basic descriptions of the drawings are similar to those of FIG. 8 and thus omitted. In FIG. 11, a region 1106 is defined as a region D. The region D 1106 has a width equal to that of the region A 606 in FIG. 6. In FIG. 6, conveyance distances in acceleration and deceleration are equal to the width of the region A. However, in FIG. 11, it can be understood that the conveyance distances in acceleration and deceleration are twice the width of the region D. If it is assumed that it takes two seconds to accelerate the recording medium, two second to decelerate the recording medium and one second to convey the recording medium at a constant speed so that the recording medium passes through the region A, the acceleration and deceleration time lengths in FIGS. 11 and 12 are four seconds since the conveyance distance corresponds to the width of two regions. The image formation time length is calculated as 118 seconds based on the above-described assumption. Further, the moving distance is 74 times that of the region D.

In FIG. 12, a region 1206 is defined as a region E. The region E 1206 has a width equal to that of the region A 606 in FIG. 6 as with the case of FIG. 11. In FIG. 6, the conveyance distances in acceleration and deceleration are equal to the width of the region A. However, in FIG. 12, it can be understood that the conveyance distances in acceleration and deceleration are twice the width of the region E. It can be understood that recording ratios in the recording conveyance numbers are different from those of the region D in FIG. 11. In FIG. 11, recording is performed only in the constant speed region as with the case of FIG. 6. In contrast, in FIG. 12, it can be understood that recording is performed in the acceleration and deceleration regions as with the case of FIG. 8. Further, as a feature of the recording method illustrated in FIG. 12, it can be understood that recording is started from when the conveyance speed becomes a half of the constant speed or greater. Accordingly, deterioration of the image quality in low-speed can be further suppressed, and the image quality can be improved.

The image formation time length in FIG. 12 is focused. The image formation time length in FIG. 12 is calculated as 112 seconds based on the time length for the recording medium to pass through each region defined as above. Further, the moving distance is 68 times the region A. It can be understood that the recording is speeded up by approximately five percent compared with the time length of 118 seconds in FIG. 11. As described above, further improvement of the image quality and speed-up can be both realized.

Figure 13:
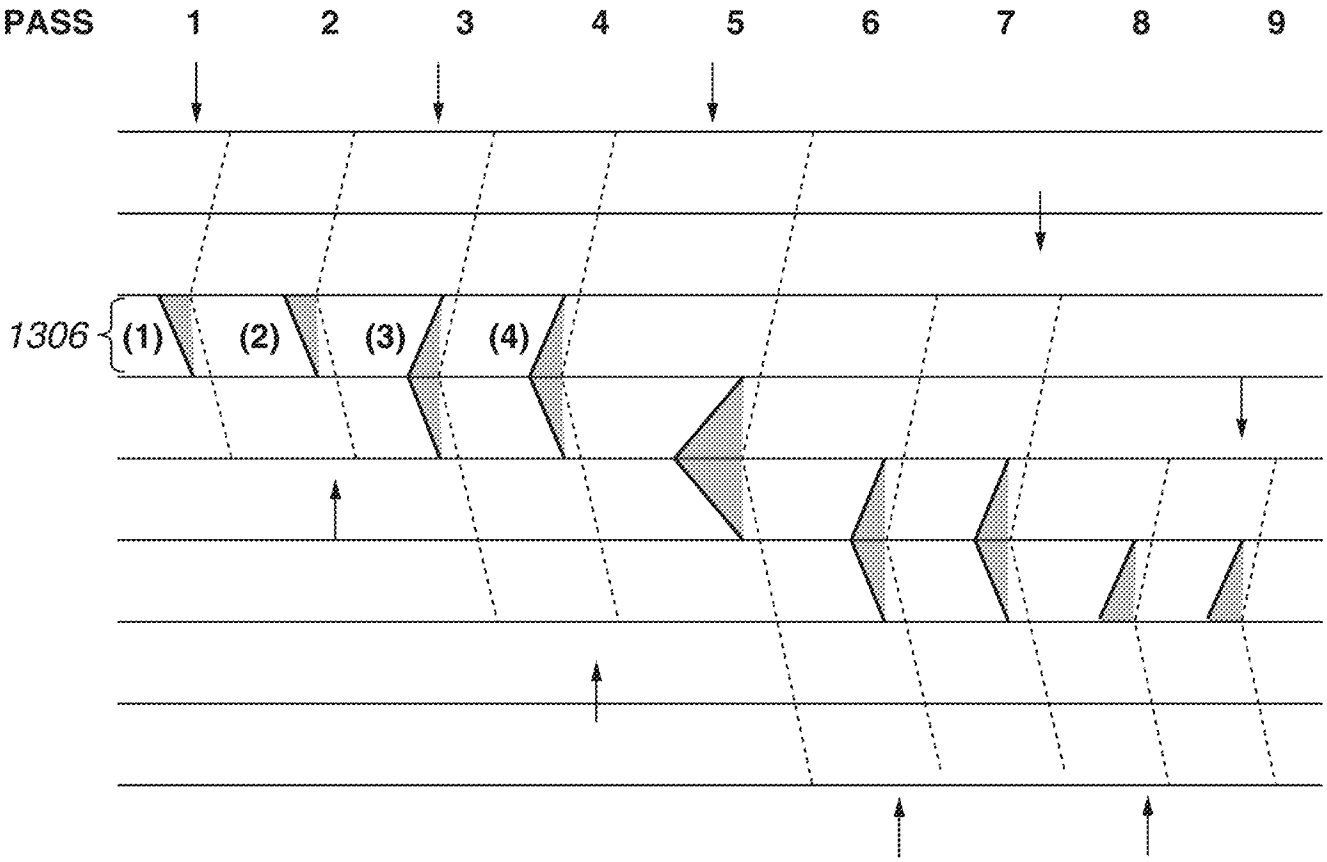
FIG. 13 is a schematic diagram illustrating multi-pass recording according to a fourth exemplary embodiment.

A recording method according to a fourth exemplary embodiment is described with reference to FIG. 13. Basic descriptions of the drawing are similar to those of FIG. 8 and thus omitted. In FIG. 13, a region 1306 is defined as a region E. It can be understood that the recording ratio is different in each of the recording conveyance numbers, and there is no recording conveyance number including the constant speed region. According to the configuration which does not include the constant speed region as described above, the recording ratio in each recording conveyance can be lowered in a low-speed portion, and the image quality in the acceleration and deceleration regions can be improved.

According to the first to the third exemplary embodiments, the image formation methods are described, and the above-described plurality of exemplary embodiments can be selected based on information about a driver, a quality to be set, and the like. For example, in a high-quality mode, the image formation method illustrated in FIG. 6 according to the first exemplary embodiment can be selected. In a high-speed mode, the image formation method illustrated in FIG. 8 according to the first exemplary embodiment can be selected, and in a super high-speed mode, the image formation method illustrated in FIG. 10 according to the second exemplary embodiment can be selected. Accordingly, the image formation method corresponding to a setting by a user can be provided.

Further, according to the first to the third exemplary embodiments, the acceleration and deceleration recording methods are described which are used in the recording apparatus in which five passes are formed. However, the recording ratio in the acceleration and deceleration regions or in the constant speed region can be appropriately set according to the number of passes, in other words, various settings such as the number of times a predetermined region of a recording medium passes through a position facing the recording head, color, and a type of the recording medium.

Further, according to the first exemplary embodiment, the number of the black squares are the same in the recording ratio of each pass in the constant speed region, in other words, the recording ratios are the same. However, as another exemplary embodiment, a recording ratio in each pass may not be fixed regardless of a constant speed region and acceleration and deceleration regions. Furthermore, according to the first exemplary embodiment, all dots are recorded with a sum total of all passes. However, as another exemplary embodiment, a sum total of all passes may include a blank in some parts, and recording may be performed for a plurality of times on a same pixel position.

According to the present disclosure, speed-up of recording can be achieved while securing an image quality of an image to be recorded.

While the present disclosure has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-193735, filed Oct. 12, 2018, which is hereby incorporated by reference herein in its entirety.

What is claimed is:

1. An ink jet recording apparatus comprising:

a recording head in which a plurality of nozzles for discharging ink is arranged to correspond to a width of a recording medium;

a conveyance unit configured to convey the recording medium in a direction intersecting with a direction in which the plurality of nozzles is arranged; and a control unit configured to cause the conveyance unit to convey the recording medium repeatedly backward and forward, to perform recording by discharging ink from the recording head to the recording medium while the recording medium is conveyed backward and forward with a predetermined region of the recording medium passing through a position facing the recording head a plurality of times, and to control the conveyance unit to accelerate or decelerate the recording medium when a direction in which the recording medium is conveyed is reversed from a forward direction to a backward direction or from the backward direction to the forward direction, wherein the control unit controls the recording head to provide that an amount of ink applied to the recording medium in a case where the recording medium is conveyed at a first speed is smaller than an amount of ink applied to the recording medium in a case where the recording medium is conveyed at a second speed higher than the first speed in both of a case where the recording medium is accelerated and a case where the recording medium is decelerated.

2. The ink jet recording apparatus according to claim 1, wherein the control unit gradually changes the amount of ink applied to the recording medium between a case where the recording medium is conveyed at the first speed and a case where the recording medium is conveyed at the second speed higher than the first speed.

3. The ink jet recording apparatus according to claim 1, wherein the control unit controls the recording head to provide that an amount of ink applied to the recording medium in a case where the recording medium is decelerated or accelerated is smaller than an amount of ink applied to the recording medium in a case where the recording medium is not decelerated or accelerated but is conveyed at the constant speed.

4. The ink jet recording apparatus according to claim 1, wherein the control unit controls the conveyance unit not to move the recording medium at the constant speed but to decelerate and accelerate the recording medium while recording is performed.

5. The ink jet recording apparatus according to claim 1, wherein the control unit changes an amount of ink applied to the recording medium in a case where the recording medium is decelerated or accelerated based on a number of times the predetermined region of the recording medium passes through the position facing the recording head.

6. The ink jet recording apparatus according to claim 1, wherein the control unit changes an amount of ink applied to the recording medium in a case where the recording medium is decelerated or accelerated based on a type of the recording medium.

7. A recording method comprising:

causing a conveyance unit to convey a recording medium repeatedly backward and forward;

performing recording by discharging ink from a recording head in which a plurality of nozzles for discharging ink is arranged to correspond to a width of the recording medium to the recording medium while the recording medium is conveyed backward and forward with a predetermined region of the recording medium passing through a position facing the recording head a plurality of times; and causing the conveyance unit to accelerate or decelerate the recording medium when a direction in which the recording medium is conveyed is reversed from a forward direction to a backward direction or from the backward direction to the forward direction, wherein an amount of ink applied to the recording medium in a case where the recording medium is conveyed at a first speed is smaller than an amount of ink applied to the recording medium in a case where the recording medium is conveyed at a second speed higher than the first speed in both of a case where the recording medium is accelerated and a case where the recording medium is decelerated.

* * * * *